US006923436B2

(12) United States Patent
Figueras Payas

(10) Patent No.: US 6,923,436 B2
(45) Date of Patent: Aug. 2, 2005

(54) PROCESS FOR THE MANUFACTURE OF SETS OF PRINTED PAGES FOR THE PREPARATION OF BOOKS, AND SET OF PRINTED PAGES MANUFACTURED BY THAT PROCESS

(75) Inventor: Domingo Figueras Payas, Sant Cugat Del Valles (ES)

(73) Assignee: Digital Internet Transport System S.I., Barcelona (ES)

( * ) Notice: Subject to any disclaimer, the term of this patent is extended or adjusted under 35 U.S.C. 154(b) by 159 days.

(21) Appl. No.: 09/835,780

(22) Filed: Apr. 12, 2001

(65) Prior Publication Data

US 2002/0020501 A1 Feb. 21, 2002

(51) Int. Cl.[7] ..... B41F 13/54

(52) U.S. Cl. ..... 270/1.01; 101/224; 101/229; 101/232; 101/481; 101/483; 101/485; 400/61; 400/76; 270/5.02; 270/21.1; 270/52.09; 270/52.14

(58) Field of Search ..... 101/224, 227, 101/229, 230, 231, 232, 485, 486, 475, 481, 407.1, 494, DIG. 36, 483; 400/61, 64, 76, 23, 28; 270/1.01, 1.02, 5.02, 21.1, 52.09, 52.14, 52.16; 405/31.48, 279

(56) References Cited

U.S. PATENT DOCUMENTS

| | | | | | |
|---|---|---|---|---|---|
| 452,933 | A | * | 5/1891 | Feister | 270/14 |
| 3,593,987 | A | * | 7/1971 | Garber | 101/226 |
| 4,708,469 | A | * | 11/1987 | Bober et al. | 271/3.01 |
| 4,737,645 | A | * | 4/1988 | Lahr | 250/458.1 |
| 4,930,912 | A | * | 6/1990 | Speicher | 400/48 |
| 5,291,227 | A | * | 3/1994 | Suzuki | 347/104 |
| 5,461,977 | A | * | 10/1995 | Germann | 101/137 |
| 6,012,890 | A | * | 1/2000 | Celorio Garrido | 270/1.02 |

FOREIGN PATENT DOCUMENTS

| | | |
|---|---|---|
| CH | 125 735 A1 | 5/1928 |
| DE | 33 12 931 A1 | 10/1984 |
| EP | 0895183 | 2/1999 |
| EP | 0992365 | 4/2000 |

OTHER PUBLICATIONS

Patent Abstract of Japan, CD–ROM PAJ G03FGH 1987–1990 (2/3)/ 59, JP 63–021666 A (Ricoh Co. Ltd.).

Rene Ponut, Diccionario de la Edicion y de las Artes Graficas, 1990, Ediciones Piramide, Madrid, pp. 376, 603–605.

Patent Abstract of Japan, CD–ROM PAJ MIJP 9408 PAJ 1994[06–209601/06–241600]/ 107/ JP 06–227176 A (Toppan Printing Co.).

China Abstract—CN 1074176 Jul. 14, 1993.

Berger, Peter; "Investieren mit Blick auf digitale Nischenprodukte"; Deutscher Drucker, Sep. 17, 1998, pp. w45–w48, XP000783487.

* cited by examiner

*Primary Examiner*—Daniel J. Colilla
*Assistant Examiner*—Jill E. Culler
(74) *Attorney, Agent, or Firm*—Darby & Darby

(57) ABSTRACT

The process is based on printing, in an electronic printing machine, the various bodies of text of the pages with symmetrical distribution with respect to the center of symmetry of the sheet being printed and likewise symmetrically with respect to one or both axes of symmetry of the initial sheet which pass through the center of symmetry thereof and which are parallel with its outer edges, the extent of the body of text varying for each page in accordance with the dimensions provided therefor and the sheet receiving the print subsequently being reversed in order to print the bodies of text corresponding to the reverse faces of the printed sheets.

7 Claims, 7 Drawing Sheets

PROCESS FOR THE MANUFACTURE OF SETS OF PRINTED PAGES FOR THE PREPARATION OF BOOKS, AND SET OF PRINTED PAGES MANUFACTURED BY THAT PROCESS

The present invention is to provide a novel process for the manufacture of sets of pages for the preparation of books, which process has original features enabling substantial advantages to be obtained over currently known processes. The invention relates also to a set of pages for the preparation of books, which set is manufactured in accordance with the mentioned process.

The process to which the present invention relates originated from investigations carried out by the inventor for the purpose of achieving greater flexibility in the printing of books, which at present, using the known methods, is rather deficient and usually requires the printing and preparation of a substantial number of books for the later distribution and sale thereof over a period of time which may be prolonged. This causes substantial problems of an economic nature and with respect to service to the market because the preparation and production of a new edition is an expensive task requiring a considerable amount of time. The object proposed by the inventor was to obtain a process which permits the manufacture of sets of printed sheets for the preparation of books and which provides great flexibility of functioning, that is to say, which permits rapid changes in the production of the book with regard to text, dimensions, number of pages, and printing parameters, such as the typeface used, colours and the like, during the actual process of printing the book. This eliminates the long waiting times currently necessary and enables books to be printed with a very reduced number of units, it being possible to print a single unit without this entailing a substantial reduction in the productivity of the industrial process of printing books.

The object proposed by the inventor has been achieved by a novel and revolutionary process which is based on a combination of printing by electronic means and the printing of the sets of sheets in an original manner starting from an initial sheet having a rectangular structure and provided with two axes of symmetry which pass through the centre of symmetry of the sheet and which are parallel with the sides thereof. In the printing stage, the text is printed and distributed symmetrically with respect to the centre of symmetry of the sheet and with reference to one or both axes of symmetry, and therefore, optionally, two symmetrical bodies of text which each correspond to pages of the book are printed in a symmetrical arrangement with respect to one of the axes of symmetry of the sheet and with a specific gap between the edge of the text and the axis of symmetry, which will be the gap that later determines the gap between the body of text of each page and the inner edge thereof, that is to say, the edge that corresponds to the spine of the book. After printing in the manner indicated, the sheet is reversed and bodies of text are printed in such a manner that they are distributed over the second face in the same manner as those on the first face of the sheet, forming the pages of text corresponding to the two sheets of the book being printed. The sheet is then folded about the reference axis of symmetry and is cut in order to determine the precise dimensions of the set of sheets in accordance with the book that it is desired to print. The process can also be applied to the printing of four bodies of text in a symmetrical arrangement with respect to the centre of symmetry of the sheet and to the two reference axes of symmetry thereof. In that case, after reversing the sheet of paper and printing on its second face, the sheet is folded about the two axes of symmetry in succession to produce a set of eight pages of text grouped into four sheets of the book which, in a manner similar to that indicated above, will be detrmined by cutting the edges to the size suitable for achieving the desired dimensions of the pages of the book.

The process to which the invention relates therefore permits the printing of bodies of text in the variable sizes desired in accordance with the dimensions of the book which it is desired to print, simply by varying the control instructions of the electronic printer which can very rapidly vary the parameters of a text, the type of paging, etc. To that end, a series of different work programmes of the electronic printer can first be produced concerning the size of the printed bodies on each sheet and their distribution, typeface, colours, etc., so that a simple pre-programmed instruction can be used for the almost instantaneous change of preparation of the electronic printing machine, passing from one definition to another of the sets of sheets for the production of a book. At the same time, the bodies of text may be collected by an associated memory in which a library of texts to be selected may be provided.

Although the dimensions of the initial sheet of paper may vary widely, it should be pointed out by way of example that, in general, the dimensions of the paper will be smaller than those currently used in conventional methods for printing books and that, with standard DIN dimensions, it is possible, for example, starting from DIN A3 dimensions and by folding about one axis, to pass to DIN A4 printing dimensions and, if the sheets are folded about both axes, to pass to final DIN A5 dimensions, which version will give book elements having 8 pages of text. It will be appreciated that it would also be possible to obtain other standard dimensions starting from DIN A2 or, in general, starting from variable dimensions of paper sheet which are determined in the process of cutting the strip of paper unrolled continuously from a roll. The desired distribution of the bodies of print and the subsequent folding and cutting operations are then carried out to obtain a set of sheets for the preparation of books of the desired size. The sets of sheets are joined later by known methods, such as adhesive bonding, punching or other means for the preparation of the complete book.

The present invention also provides features enabling the folded sets of sheets to be readily handled by clamp systems. For the purpose of handling sets of sheets mechanically, for example, for stitching purposes, it is necessary to grip the sets of sheets by means of a pincer device in order to transport them and present them for stitching. The present invention provides for the displacement of the reference axes of the base carrying the sheets with respect to the printing means of the machine in such a manner that the printing unit, which is generally formed by four evenly distributed quarters, is at a sufficient distance from one of the edges to make available, when folding is later carried out about an axis of symmetry of said printed forms or parts, a fringe region which permits easy gripping by means of pincers for the purpose indicated above, that is to say, the stitching of a book.

The axes can be displaced by displacing the base carrying the paper in the direction of one or other of the coordinate axes and it is also possible to effect that displacement automatically by providing, on the base carrying the sheets to be printed, a sheet which is misaligned with respect to one of the reference edges. This can be achieved, for example, by arranging a shorter sheet in such a manner that, when three of its sides are lined up, the fourth side, which may correspond to one of the lateral edges of the sheet, is displaced, causing complete displacement of the printing carried out, normally four quarters separated in a regular manner, which produces a free fringe region at the edge opposite that which was initially arranged in a misaligned manner.

Some drawings showing diagrammatically the process to which the present invention relates are appended by way of non-limiting explanatory example for a better understanding thereof.

Figure 2:
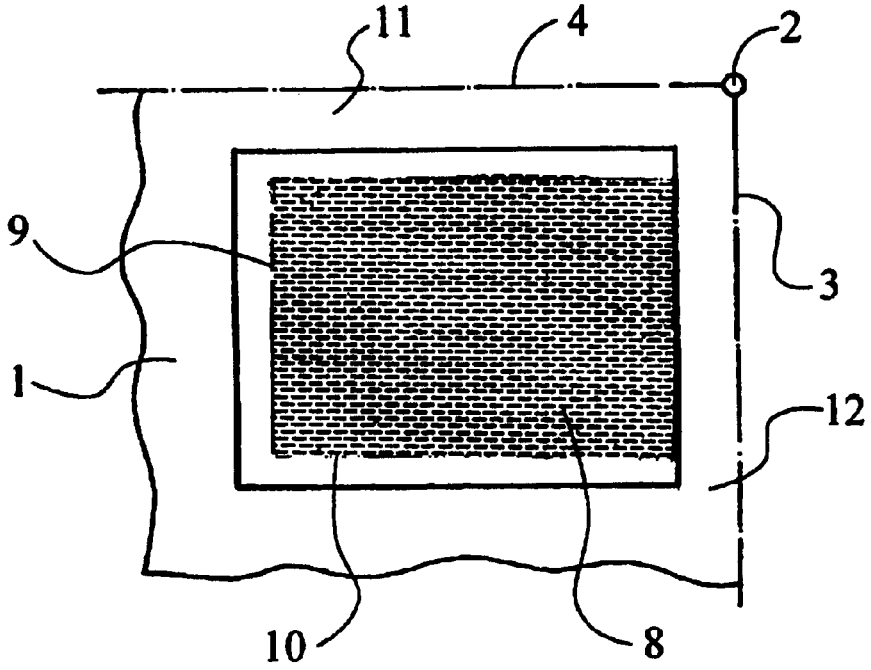
FIG. 2 shows a detail of a body of text according to the present process.

As will be appreciated from the drawings, the process to which the present invention relates is based on effecting, in an electronic printer, the distribution of bodies of text on a sheet 1 in a symmetrical manner with respect to the centre of symmetry 2 of the sheet and with respect to one or two of the mutually perpendicular axes of symmetry 3 and 4 which are parallel with the edges of the sheet 1 and which pass through the centre of symmetry 2. The bodies of text, for example those indicated in the drawing with the numerals 5, 6, 7 and 8, are spaced with respect to the axes of symmetry in accordance with variable regions which later determine the spacing of the body of text with respect to the central or inner line of the book. The extent of the text will vary with regard to the outer edges which, in the case of the body of text 8, have been indicated with the numerals 9 and 10. That variation will permit the manufacture of various sizes of printed page, as indicated above. Therefore, as shown in the detail of FIG. 2, it is possible to vary the gaps 11 and 12 between the body of text 8 and the axes of symmetry 3 and 4, and also to vary the outer edges, such as 9 and 10, depending on the extent of the body of printed text on each page.

Figure 1:
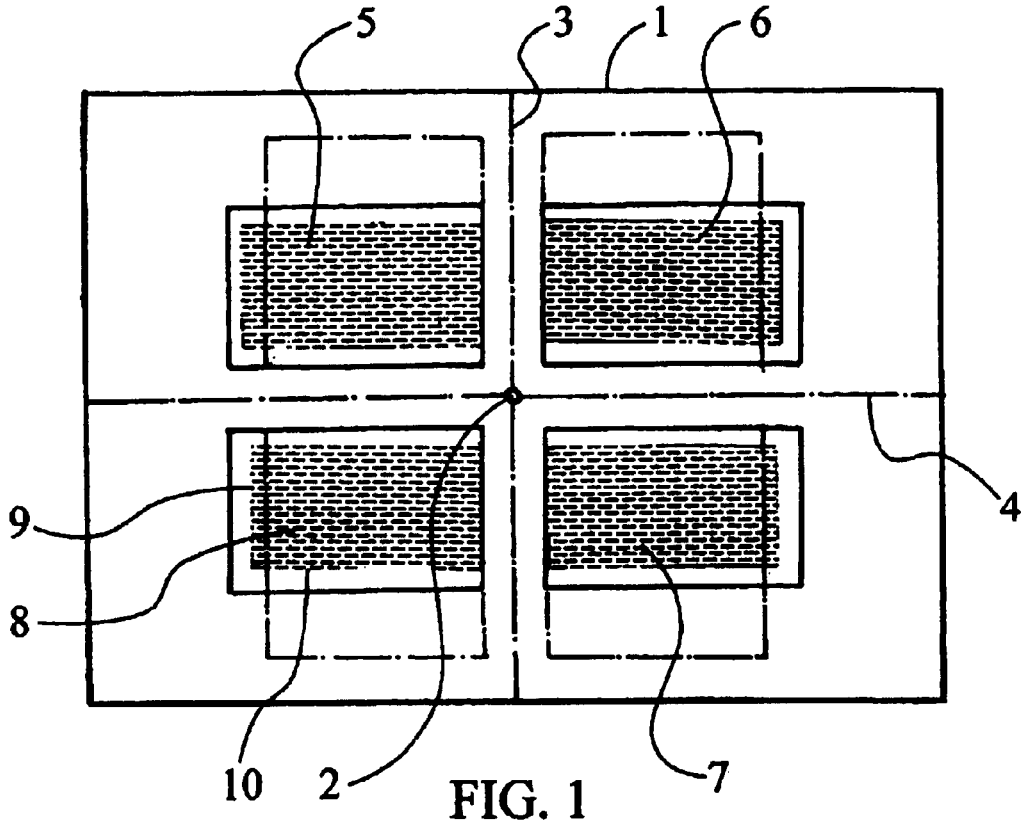
FIG. 1 shows diagrammatically an initial sheet of paper having four bodies of text distributed thereon.
Figure 3:
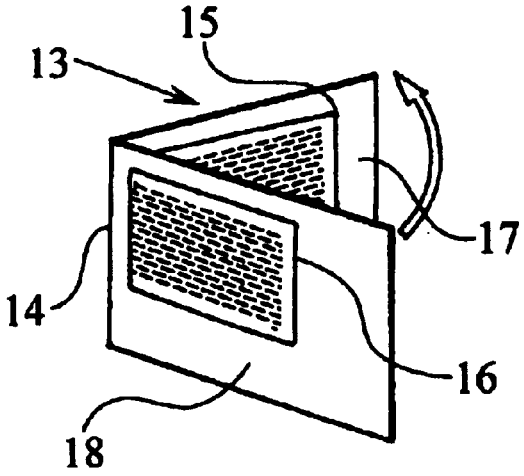
FIGS. 3, 4 and 5 show details of the folding and cutting of a sheet turned over about a single axis of symmetry.
Figure 4:
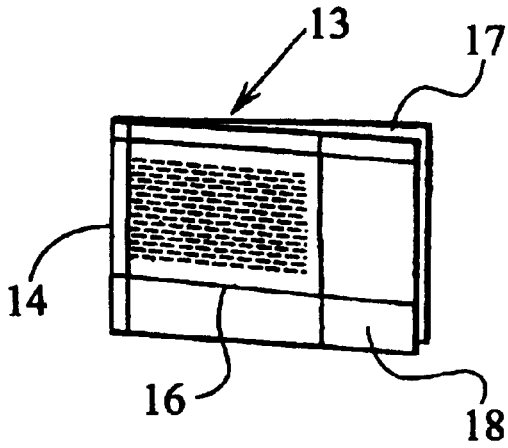
Figure 5:
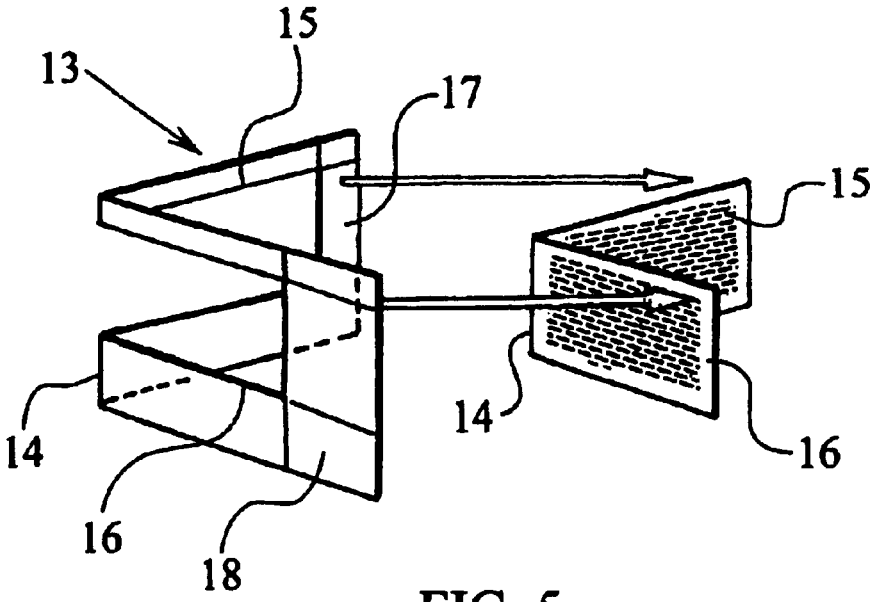
Figure 6:
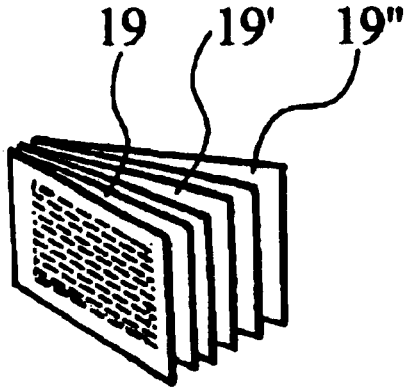
FIG. 6 shows diagrammatically the joining of various sets of sheets to form a larger set.

After the body of text has been printed on one face of the sheet 1, the sheet is reversed in order to effect in a continuous process the corresponding printing on the other face of the sheet. The sheet is then folded about one or two axes, depending on whether the bodies of text have been distributed beforehand in two regions on each face or in four regions, as shown in FIG. 1. If two bodies of text have been printed on each face of the sheet, as shown in FIG. 3, the sheet 13 is folded about the axis 14 to produce two sheets 15 and 16 and to leave surplus regions 17 and 18 which, by subsequent cutting, FIG. 5, will give the set of two sheets of the book which will successively be piled up as indicated in FIG. 6 in accordance with the desired number of sets of sheets, to form, in the example shown, a set of six sheets indicated with the numerals 19, 19', 19" . . . .

Figure 7:
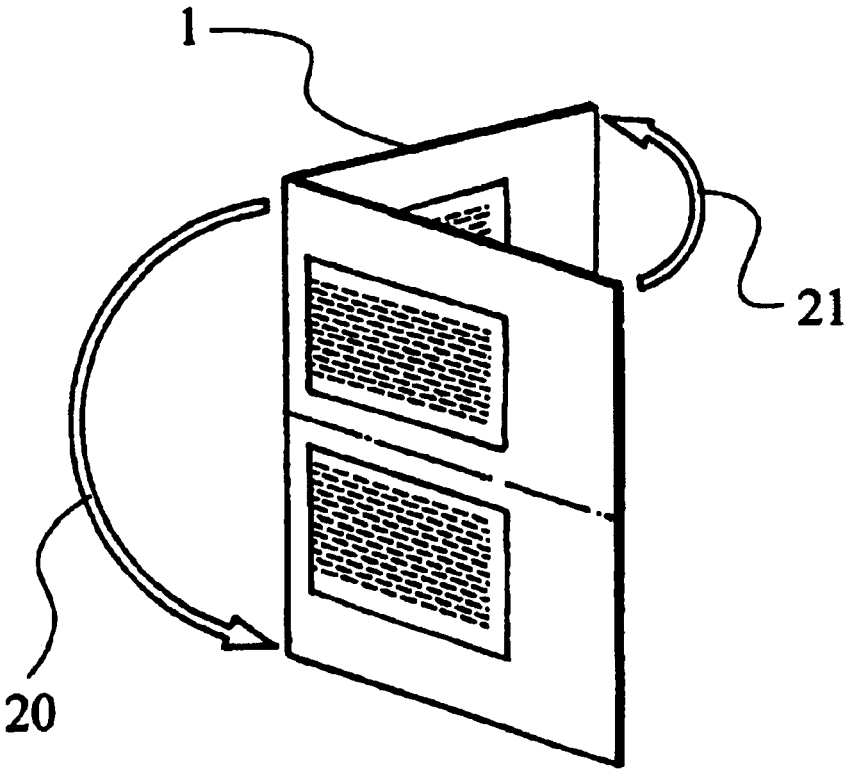
FIG. 7 shows diagrammatically the folding of a set of sheets about two axes of symmetry.
Figure 8:
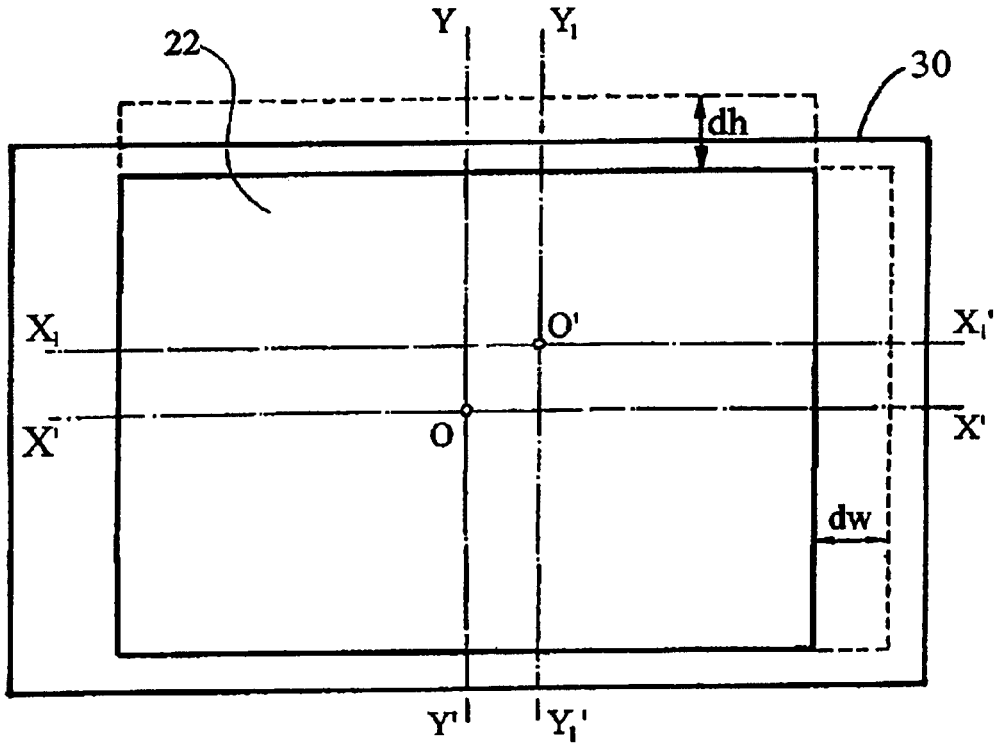
FIG. 8 is a plan view showing the displacement of the axes.

FIG. 7 shows the case where four bodies of text are printed on each face of the sheet of paper, so that, the sheet of paper indicated with the same numeral 1 as in FIG. 1 is subsequently folded about the two axes of symmetry, the directions of folding having been represented by the arrows 20 and 21, respectively, a set of four sheets being produced, which sheets are equivalent to eight pages of the book and will be gathered together later in a manner similar to that shown in FIG. 6, finally to obtain the desired book by joining the various sets of sheets.

Figure 9:
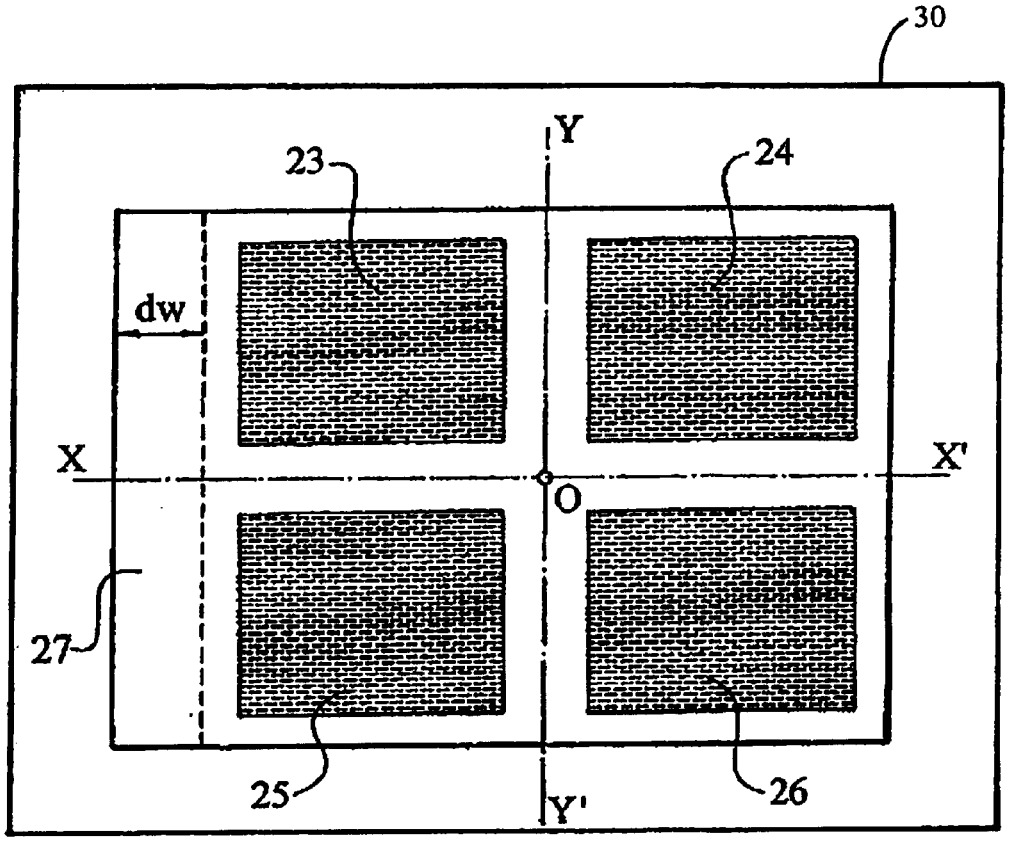
FIG. 9 shows the printing of the sheet, producing a free lateral border enabling it to be gripped by pincers.
Figure 10:
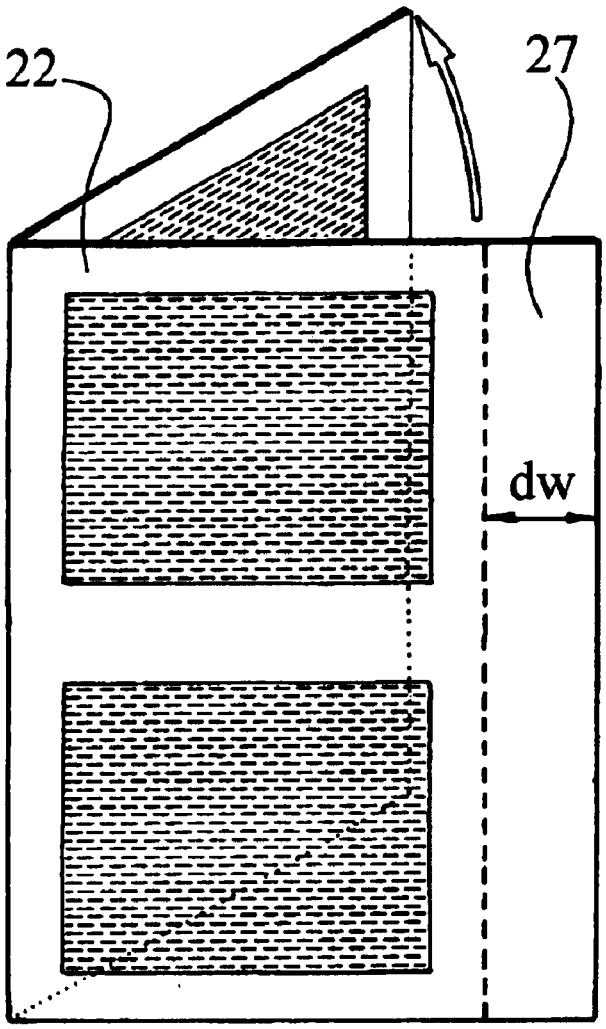
FIG. 10 shows an example of the coincidence of sheets with a fringe region to be gripped by pincers.

In order to permit easy handling of folded sets by means of pincers, the present invention provides that the principle axes of symmetry X,X' and Y,Y' may be displaced by distances such as dh and dw, which means that the sheet 22 can receive the displaced print as illustrated in FIG. 9, which, by way of example, shows four printed pages 23, 24, 25 and 26. In the case shown, this is due to a displacement of the axis Y by the distance dw to occupy the position of the axis $Y_1$,$Y_1$' and to give a lateral edge strip 27 which can permit gripping by pincers when the sheet has been folded. It will be appreciated that, if it is desired to have edge strips on both sides, that could be achieved by changing the size of the sheet with respect to the centering base 30.

Figure 11:
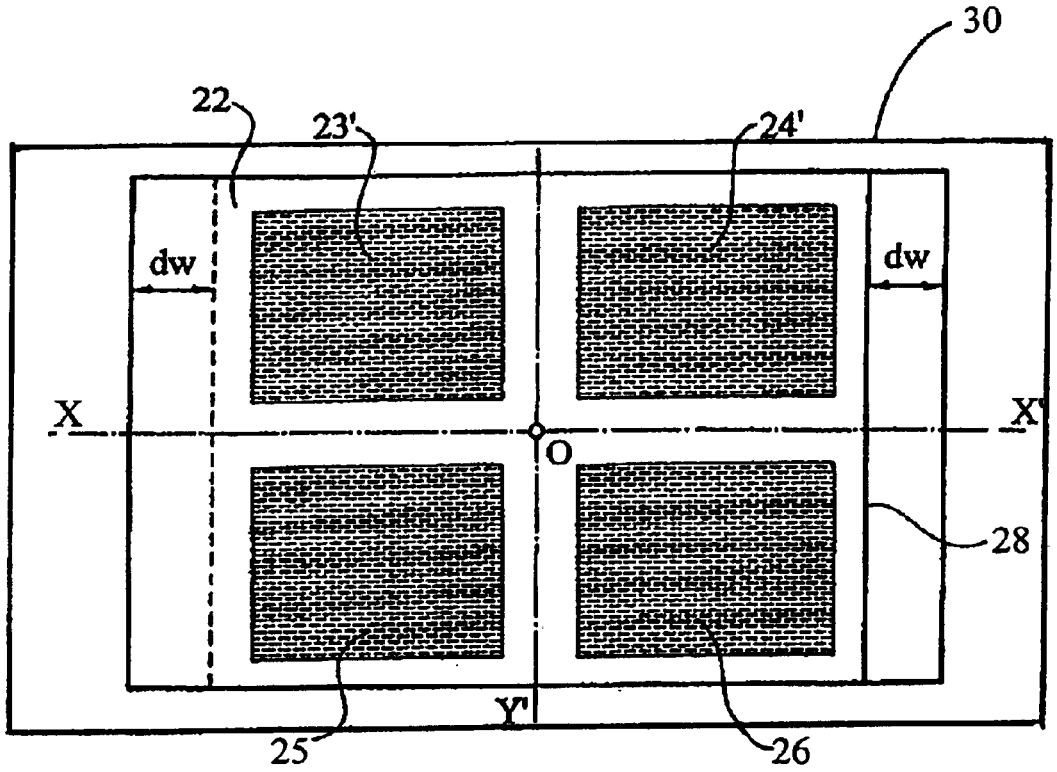
FIG. 11 shows the printing of a sheet with an off-centre edge.

As shown in FIG. 11, it would be possible for the sheet 22 to be off-centre with respect to the support table 30, which could mean that the edge 28 would correspond to a shorter overall length of the sheet, and therefore the printing of the various pages 23', 24', 25' and 26', in a centred manner with respect to the machine table 30, will enable the free lateral edge strip dw to be obtained.

The electronic printers used in the present invention are associated with memories, for the content of the texts of the pages, and electronic means which can be controlled from outside in order to determine the surface area occupied by the text and the parameters which define the text, such as typeface, colours, etc.

What is claimed is:

1. A process for manufacturing sets of printed pages for the preparation of books, comprising the steps of unrolling paper from a feed roller and subsequently cutting a sheet of paper before the sheet is supplied to a printing machine, which then prints bodies of text on the sheet, wherein, in an electronic printing machine having a memory for the content of the bodies of text and an electronic controller for determining a surface area occupied by the bodies of text and parameters defining the bodies of text, printing the bodies of text with a symmetrical distribution with respect to a centre of symmetry of the sheet being printed and likewise symmetrically with respect to two axes of symmetry, which pass through the centre of symmetry and which are parallel with outer edges of the sheet, varying at least one of the outer edges of the bodies of text in accordance with dimensions provided therefor, and subsequently reversing the sheet in order to print bodies of text corresponding to reverse faces of the printed sheet and then folding the printed sheet about both of the axes of symmetry in order to produce a set of pages which are cut at the outer edges in accordance with the dimensions of the printed pages of text, and joining and binding the various sets of pages to form the book.

2. The process according to claim 1, wherein the bodies of text are printed on a sheet of standard DIN size, the folding of which about both axes of symmetry passing through the centre of symmetry of the sheet produces sets of pages of another standard size.

3. The process according to claim 1, wherein the adjustment of the parameters determining the bodies of text and the arrangement thereof on the sheet is effected by the electronic controller, which is externally operated, without stopping the continuous process of manufacture.

4. The process according to claim 1, wherein each sheet is printed in an off-centre manner to produce a lateral edge strip which is parallel with one of the edges of the sheet, in order to enable the sheet to be gripped by pincers after the printed sheet has been folded.

5. The process according to claim 1, wherein the sheet is arranged with its edge displaced with respect to a reference edge of a base carrying the sheet, printing being effected in accordance with coordinate axes of the base, to produce a lateral edge for gripping.

6. A set of pages manufactured in accordance with the process of any one of the preceding claims, wherein the set of pages comprises a sheet on which is distributed bodies of text which correspond respectively to pages of a book and which are arranged symmetrically with respect to the centre of symmetry of the sheet and with respect to the two axes of symmetry which pass through the centre of symmetry and which are parallel with the outer edges of the sheet, the sheet being folded about the one axis of symmetry if two symmetrical bodies of text are printed on each face of the sheet, or being folded about both axes if there are four bodies of text for respective pages on each face of the sheet.

7. A process for manufacturing sets of printed pages for the preparation of books, comprising the steps of unrolling paper from a feed roller and subsequently cutting a sheet of paper before the sheet is supplied to a printing machine, which then prints bodies of text on the sheet, wherein, in an electronic printing machine having a memory for the content of the bodies of text and an electronic controller for determining a surface area occupied by the bodies of text and parameters defining the bodies of text, printing the bodies of text with a symmetrical distribution with respect to a centre of symmetry of the sheet being printed and likewise symmetrically with respect to one or two axes of symmetry, which pass through the centre of symmetry and which are parallel with outer edges of the sheet, varying at least one of the outer edges of the bodies of text in accordance with dimensions provided therefor, and subsequently reversing the sheet in order to print bodies of text corresponding to reverse faces of the printed sheet and then folding the printed sheet about one or both of the axes of symmetry in order to produce a set of pages which are cut at the outer edges in accordance with the dimensions of the printed pages of text, and joining and binding the various sets of pages to form the book, wherein a lateral edge strip is produced by a displacement of a base carrying the sheet along one or other of coordinate axes of a magnitude equal to that of the desired edge strip.

* * * * *

UNITED STATES PATENT AND TRADEMARK OFFICE

CERTIFICATE OF CORRECTION

PATENT NO. : 6,923,436 B2
DATED : August 2, 2005
INVENTOR(S) : F. Payas

It is certified that error appears in the above-identified patent and that said Letters Patent is hereby corrected as shown below:

Title page,
Item [73], Assignee, please delete "Digital Internet Transport System S.I., Barcelona (ES)" and substitute -- Digital Internet Transport System S.L., Barcelona (ES) --.
Insert Item -- [30], Foreign Application Priority Data,

ES …….200001019 04/19/2000
ES …….200100731 03/29/2001 --.

Signed and Sealed this

Thirteenth Day of December, 2005

JON W. DUDAS
*Director of the United States Patent and Trademark Office*